US007805797B2

(12) United States Patent
Douglas et al.

(10) Patent No.: US 7,805,797 B2
(45) Date of Patent: Oct. 5, 2010

(54) PAINT BRUSH WITH CANTILEVERED CLAMPING PANEL AND REMOVABLE BRISTLE PACK

(76) Inventors: Terry R. Douglas, #309 - 13395 76th Avenue, Surrey, BC (CA) V3W 6K2; Lloyd E. Philip, #37 Hope Trace, Hope Village (TT)

( * ) Notice: Subject to any disclaimer, the term of this patent is extended or adjusted under 35 U.S.C. 154(b) by 1059 days.

(21) Appl. No.: 11/530,817

(22) Filed: Sep. 11, 2006

(65) Prior Publication Data

US 2008/0060158 A1 Mar. 13, 2008

(51) Int. Cl.
*A46B 7/04* (2006.01)

(52) U.S. Cl. ..... 15/202; 15/177; 15/178

(58) Field of Classification Search ..... 15/202, 15/204, 168, 169, 171, 177, 178, 205, 146, 15/159.1, 192–194, 176.1, 176.4, 176.5
See application file for complete search history.

(56) References Cited

U.S. PATENT DOCUMENTS

| | | | | | |
|---|---|---|---|---|---|
| 1,358,369 | A | * | 11/1920 | Forester | 15/178 |
| 2,326,879 | A | * | 8/1943 | Neuhausen | 15/202 |
| 3,874,021 | A | | 4/1975 | Jacobs | |
| 4,129,918 | A | | 12/1978 | Lee | |
| 4,237,579 | A | | 12/1980 | Salmon | |
| 4,339,837 | A | | 7/1982 | Reeberg | |
| 5,218,733 | A | | 6/1993 | Leu | |
| 5,289,606 | A | | 3/1994 | Ledingham | |
| 5,315,733 | A | | 5/1994 | Ledingham | |
| 5,343,585 | A | | 9/1994 | Howell | |
| 5,435,037 | A | * | 7/1995 | Ledingham | 15/168 |
| 5,678,276 | A | * | 10/1997 | Ledingham et al. | 15/168 |
| 6,035,481 | A | | 3/2000 | Douglas et al. | |
| 6,295,685 | B1 | | 10/2001 | Douglas | |
| 6,510,578 | B1 | * | 1/2003 | Cyr et al. | 15/176.6 |

FOREIGN PATENT DOCUMENTS

| | | |
|---|---|---|
| DE | 86377 | 7/1895 |
| WO | 96/17536 | 6/1996 |
| WO | 9632034 A1 | 10/1996 |
| WO | 2005006933 A2 | 1/2005 |

* cited by examiner

*Primary Examiner*—Dung Van Nguyen
(74) *Attorney, Agent, or Firm*—Oyen Wiggs Green & Mutala LLP

(57) ABSTRACT

This invention pertains to a novel paint brush with a removable bristle pack and a cantilevered bristle clamping panel. The paint brush provides ready cleaning after use by depressing one end of the cantilevered bristle clamping panel to release the bristle pack in order to rinse all of the bristles in a cleaning solution. A paintbrush comprising: (a) a paintbrush body and handle, the body having formed therein a cavity open on one side for receiving a bundle of parallel bristles and a bristle holder; (b) a bristle holder holding a bundle of parallel bristles, the holder fitting into the cavity; and (c) a panel mounted in cantilever manner over the cavity, the panel at a first end gripping the bristle holder and bristles when in a first position and when in a second position releasing the bristle holder and bristles.

15 Claims, 6 Drawing Sheets

PAINT BRUSH WITH CANTILEVERED CLAMPING PANEL AND REMOVABLE BRISTLE PACK

FIELD OF THE INVENTION

This invention pertains to a novel paint brush with a removable bristle pack and a cantilevered bristle clamping panel. The paint brush provides ready cleaning after use by depressing one end of the cantilevered bristle clamping panel to release the bristle pack in order to rinse all of the bristles in a cleaning solution.

BACKGROUND OF THE INVENTION

A longstanding problem with paint brushes that are used for industrial and domestic painting applications is that with time and repeated use, paint tends to build up within the bristles of the brush in the region where the bristles are held by the ferrule clamp that joins the bristles with the paint brush handle and base. The collected paint in this confined area is difficult to clean away. Usually, some residual paint is left in the bristles at the junction with the ferrule even after the used brush has been cleaned. The dried paint at this location collects and builds up over time with repeated use of the paint brush. This causes the bristles of the brush to spread and thereby reduces the efficiency of the brush. Also, the build up of dried paint tends to cause the bristles to wear and break at the location of the dried paint. This reduces the life of the paint brush.

Proper cleaning of a paint brush requires a considerable amount of solvent, if the person cleaning the brush is meticulous. If the paint has a water base, large amounts of water are wasted attempting to thoroughly clean the brush. If the paint is an oil base paint, then expensive petroleum paint solvent or thinner is required for cleaning. The use of a petroleum base solvent constitutes a waste of costly solvent and at the same time creates an environmental pollutant. Most commercial painters will tend to minimize costs by balancing the amount of the solvent used with the number of times the paint brush is used. It may be economic, for instance, to only expect a paint brush to be used a half-dozen times before it must be discarded, rather than incur the cost and waste a considerable amount of solvent attempting to meticulously clean the brush after each use, and prolong the life of the paint brush.

It would be advantageous if a paint brush could be designed which would minimize or eliminate the build up of paint in the location where the bristles are set or meet the paint brush handle. It would also be useful if a mechanism could be developed to reduce the amount of solvent which is required to clean a paint brush. It would also be advantageous if the bristles could be readily removed from the paint brush handle, for cleaning, and the clean bristles reinstalled in the handle for further painting. It would also be advantageous if the mechanism holding the bristles was resistant to breakage.

U.S. Pat. No. 5,289,606, issued Mar. 1, 1994, Blake A. Ledingham, discloses a unitary paint brush which comprises a paint brush body attached to a handle. The body defines a cavity adapted for receiving a group of bristles. A pair of hinged releasable flaps project over the cavity to abut the bristles when moved to a closed position. The bristles are released by moving the flaps into an open position. The hinged flaps are held in place on the bristle pack base by springs which can be rotated from a flap open position to a flap closed position, and vice versa. A problem with the springs is that they are a separate component, are cumbersome and raise manufacturing expense.

U.S. Pat. No. 5,315,733, May 31, 1994, Blake A. Ledingham, discloses a paint brush bristle clamp which can be applied over the ferrule and part of the bristles of a paint brush before use, and which deters paint from migrating from the free end of the bristles to the ferrule. The clamp is removed after the brush is used so that the bristles at the ferrule are exposed. The bristles are easy to clean after the clamp is removed.

International Patent Application No. PCT/CA95/00677, Blake A. Ledingham et al., published under number WO 96/17536 discloses: (a) a paint brush construction comprising a paint brush body and handle, the body having formed in one end thereof a cavity for receiving a group of bristles; and (b) a hinged bristle bearing member positioned proximate to the cavity, the member when moved about the hinge to a closed position applying a force against bristles held within the interior of the cavity, and the member when moved about the hinge to an open position enabling bristles held within the cavity to be removed. However, the hinged bristle bearing member can move only about a pivot point that is fixed. That pivot point is incapable of yielding when the bristle bearing member encounters an undue force, making the mechanism susceptible to breakage.

German Patent No. 86377 discloses a mechanism for holding and removing broom or brush bristles through a pivoting frontal flap d, which pivots about fixed pin f to engage the bristles at a protrusion h. However, this broom construction is also susceptible to breakage if undue force is applied to the rigid pivot f.

U.S. Pat. No. 4,129,918, Dec. 19, 1978, Robert Lee, discloses an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. The sleeve does not fit over the base of the brush at the location where the bristles meet the base.

U.S. Pat. No. 4,237,579, Dec. 9, 1980, Jonathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base. The tool is not designed to prevent paint from migrating down the bristles in the direction of the base.

U.S. Pat. No. 4,339,837, Jul. 20, 1982, Christiaan Reeberg, discloses a sliding box-like girdle which fits over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, and thereby prevent paint from migrating along the bristles to the base, and thereby collecting at the base-bristle ended face.

U.S. Pat. No. 6,035,481, Mar. 14, 2000, Douglas et al., discloses a novel paint brush with inverted bristle clamping panel, a removable bristle pack and a panel hinge yield mechanism. The paint brush provides ready cleaning after use by disengaging the hinged inverted bristle clamping panel, removing the bristles and thereby exposing all of the bristles to the cleaning solution. The panel has a resilient release mechanism which yields slightly when undue force is applied to the inverted hinged panel against the bristles. A paint brush construction comprising: (a) a paint brush body and handle, the body having formed therein a cavity for receiving a group of bristles; (b) a pivotal bristle bearing member positioned proximate to the cavity, the bristle bearing member when pivoted to a closed position applying a holding force against bristles held within the cavity, and the member when pivoted to an open position enabling bristles held within the cavity to be removed; and (c) a resilient yield location associated with the paint brush body and the pivotal bristle bearing member which enables the pivotal bristle bearing member to yield when the bristle bearing member encounters an undue force when being pivoted to the closed position.

U.S. Pat. No. 6,295,685 B1, Oct. 2, 2001, Douglas, discloses an internal ferrule which is used in a paint brush that has a removable bristle pack and one or more moveable bristle clamping panels which, when in a closed position, grip the bristle pack and prevent paint from migrating up the bristles to the base of the paint brush handle. The paint brush with the internal ferrule and the removable bristle pack is easy to use, and provides ready cleaning after use, by releasing the one or more panels and enabling the bristle pack to be removed and exposed to the cleaning solution. An internal ferrule for use with a paint brush handle and a removable bristle pack comprising: (a) a hollow girdle for encircling a first end of a bundle of parallel bristles, the girdle having interior and exterior faces; (b) a concave glue cavity formed in an interior face of the hollow girdle; and (c) a protrusion formed on an exterior face of the girdle for engaging with a corresponding cavity formed in the body of a paint brush handle.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The invention is directed to a paintbrush comprising: (a) a paintbrush body and handle, the body having formed therein a cavity open on one side for receiving a bundle of parallel bristles and a bristle holder; (b) a bristle holder holding a bundle of parallel bristles, the holder fitting into the cavity; and (c) a panel mounted in cantilever manner over the cavity, the panel at a first end gripping the bristle holder and bristles when in a first position and when in a second position releasing the bristle holder and bristles.

The bristle holder can have on at least one side thereof a ridge which can fit in a guide groove formed in one side of the cavity. The bristle holder can have a pair of ridges, located on opposite sides of the bristle holder.

The panel can have on opposite sides thereof protrusions which can fit in corresponding holes formed in the sides of the paintbrush body, thereby enabling the panel to be moved in a cantilever manner in relation to the paint brush body. The panel can have formed therein a bristle gripping ridge. The panel can have formed therein a second bristle gripping ridge.

The cavity can include in the interior thereof a spring means which when in a neutral position can hold the panel in a bristle gripping manner and when depressed can enable the panel to tilt to release the bristle pack.

The bristle holder can have formed in the interior thereof a bristle gripping ridge.

The panel can include thereon opposite the bristle clamping end of the panel a location for depressing the panel. The panel can have formed on the underside thereof a device which can prevent the panel from being depressed beyond a certain point. The device can be a post.

The spring means of the paintbrush can be a clip or a coil spring. The panel can have a rectangular configuration or a pentagonal configuration.

In addition to the exemplary aspects and embodiments described above, further aspects and embodiments will become apparent by reference to the drawings and by study of the following detailed description.

DRAWINGS

Exemplary embodiments are illustrated in referenced figures of the drawings. It is intended that the embodiments and figures disclosed herein are to be considered illustrative rather than restrictive.

DETAILED DESCRIPTION OF SPECIFIC EMBODIMENTS OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Unlike conventional paint brushes, which typically are constructed of a wooden handle, a ferrule, a bristle separating member, nails and bristles, the main components of the paint brush according to the invention comprise four pieces, namely a one-piece injection molded handle with bristle pack receiving cavity, and a bristle holder, a cantilevered bristle gripping panel and a panel pressure yield spring. The panel pressure yield spring holds the cantilevered panel in a bristle pack holding position unless the panel is pressed at a pressure site to tip the panel upwardly and release the bristle pack.

Figure 1:
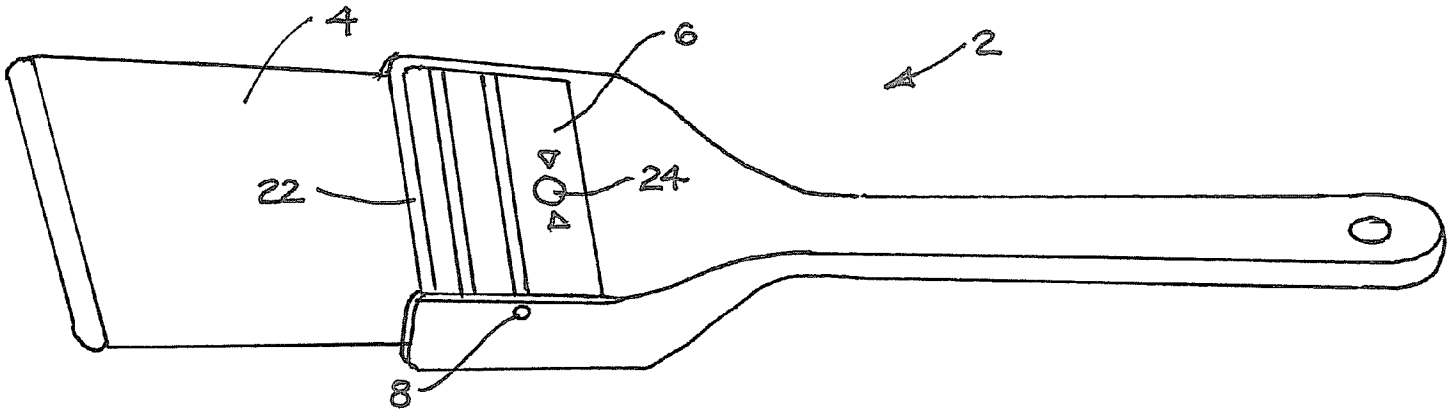
FIG. 1 illustrates an isometric view of a paintbrush with a cantilevered bristle pack gripping panel.

Referring to the drawings, FIG. 1 illustrates an isometric view of a paintbrush with the cantilevered bristle pack gripping panel according to the embodiment of the invention. As seen in FIG. 1, the paintbrush 2 is constructed with a removable bristle pack 4 and a cantilevered bristle pack clamping panel 6, which pivots about pivot point 8. The removable bristle pack 4 can be removed from the cavity in the base of the paint brush 2 by pressing down on the cantilevered bristle gripping panel 6 at pressure site 24. This action tilts the opposite end 22 of the panel 6 upwardly, thereby releasing pressure exerted by the bristle clamping ridge 22 on the bristle pack 4.

Figure 2:
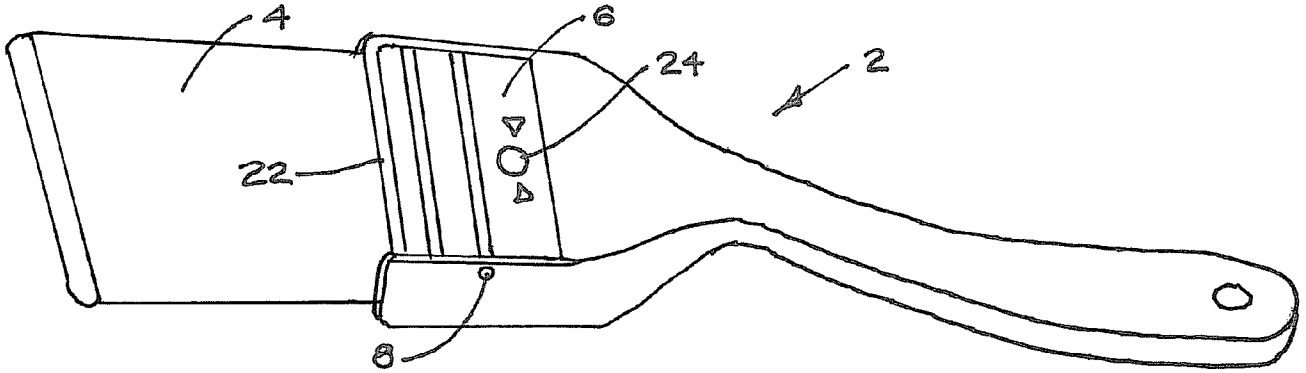
FIG. 2 illustrates an isometric view of a paintbrush with a cantilevered bristle pack gripping panel and an ergonomically shaped handle.

FIG. 2 illustrates an isometric view of a paintbrush with cantilevered bristle pack gripping panel and an ergonomically shaped handle which is a second embodiment of the invention. Essentially, the basic construction of the brush is the same except that the ergonomic shaped handle 12 provides a hand friendly configuration which enables a painter to grip and to control the paintbrush 2.

Figure 3:
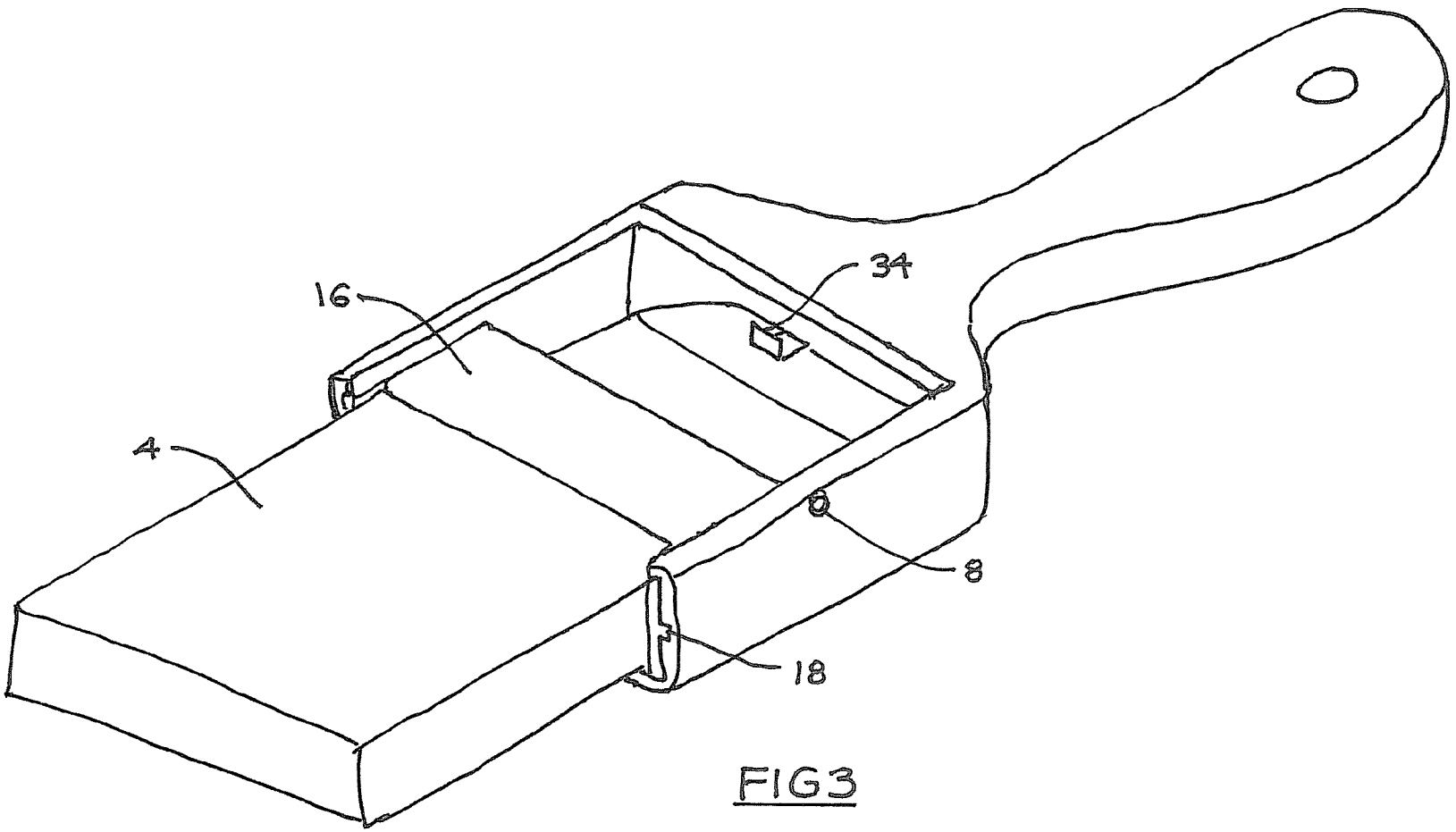
FIG. 3 illustrates an isometric view of a paintbrush with cantilevered panel removed, thereby illustrating the manner in which the bristle pack fits within the interior cavity of the body of the paintbrush.

FIG. 3 illustrates an isometric view of a paintbrush with the cantilevered panel removed, thereby illustrating the manner in which the bristle pack 4 and bristle holder 16 fit within the interior of the base of the paintbrush. As seen in FIG. 3, the bristle pack 4 with its glued end encased in the bristle holder 16 has ridges 18 on each side which enable the bristle holder 16 to slide readily into the cavity in the body of the paintbrush. The ridges 18 fit in corresponding grooves which are formed in the side walls of the cavity in the body of the paintbrush. When the cantilevered bristle pack gripping panel 6 is in place, bristle pack 4 with bristle holder 16 can still be inserted readily into and removed from the cavity along the grooves formed in the side walls of the cavity of the paintbrush. Also seen in FIG. 3, is a clip spring 34 which is embedded in the handle-end of the cavity of the paintbrush.

Figure 4:
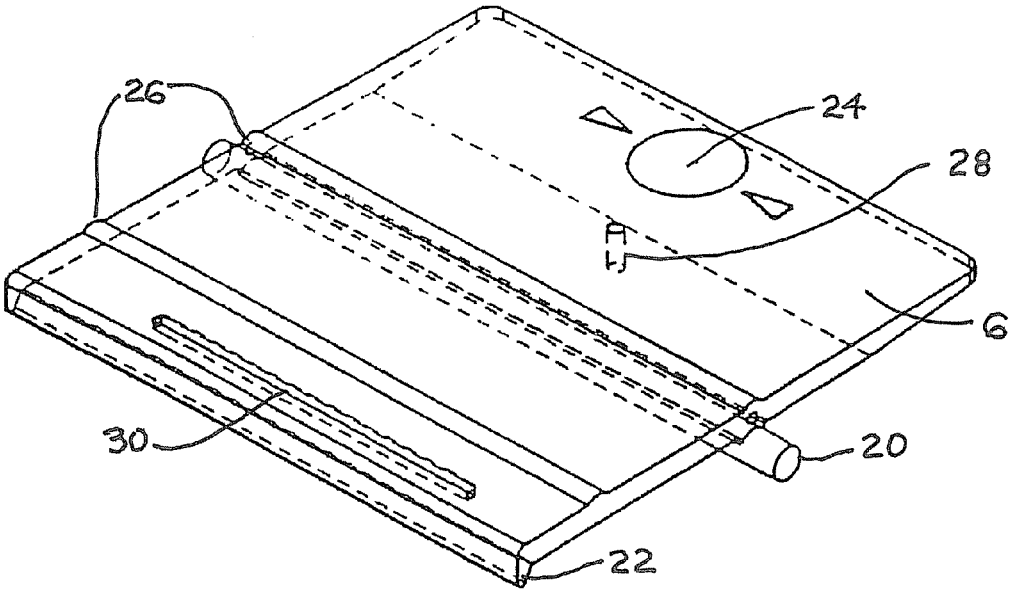
FIG. 4 illustrates an isometric view of a cantilevered bristle clamping panel.

FIG. 4 illustrates an isometric view of a cantilevered bristle clamping panel. As seen in FIG. 4, the cantilever bristle pack gripping panel 6 is constructed with a pivot rod 20 extending laterally on the underside across the width of the panel 6. A downwardly extending bristle clamp ridge 22 is formed in one end of the panel 6. That end of the panel also has on the underside of the panel a parallel bristle gripping ridge 30 which enhances gripping action of the panel 6 on the bristle pack 4. The ridges 22 and 30 also retard paint seeping into the bristles which are under the panel 6. A pair of laterally extending stiffening ridges 26 are formed in the top of the panel 6. A circular concave depression in the opposite end of the panel 6 forms a pressure site 24. When depressed at this site, the panel tilts along rod 20, thereby lifting ridge 22.

Figure 5:
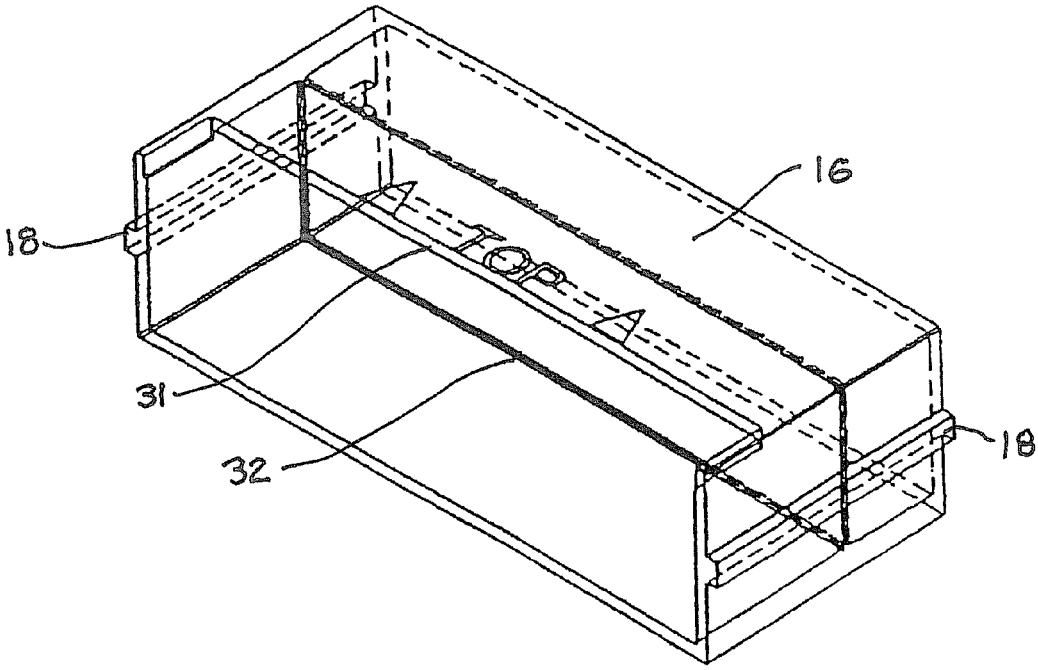
FIG. 5 illustrates an isometric view of a box-shaped bristle holder.

FIG. 5 illustrates an isometric view of a box-shaped bristle holder. As seen in FIG. 5, the bristle holder 16 has a hollow box-like construction. A pair of guide ridges 18 are formed on the exterior of each side of the holder 16. The interior of the holder 16 has formed therein a ridge 32 which assists in enabling the holder 16 to hold the bristles. The ridge 32 exerts pressure on the bristles and retards paint migration along the bristles.

Figure 6:
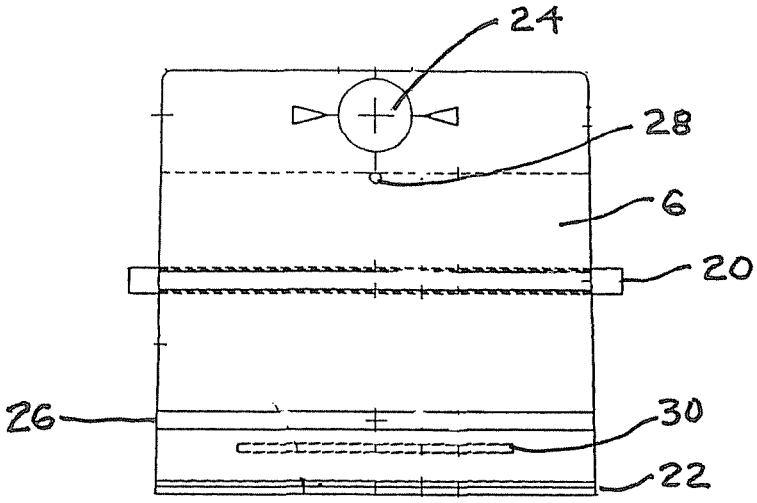
FIG. 6 illustrates a plan view of a cantilevered bristle clamping panel.

FIG. 6 illustrates a plan view of a cantilevered bristle clamping panel. As seen in FIG. 6, the panel 6 has a laterally extending pivot rod 20, the ends of which fit in corresponding holes formed in each side of the cavity in the paint brush body (see FIG. 1). The panel 6 also has formed on the top side, stiffening ridges 26 and pressure site 24. The panel 6 has formed on the underside, bristle clamping ridge 22, gripping ridge 30 and downwardly protruding post 28.

Figure 7:
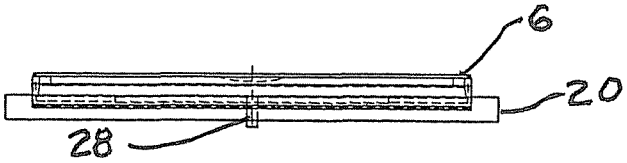
FIG. 7 illustrates an end view of a cantilevered bristle clamping panel.
Figure 8:
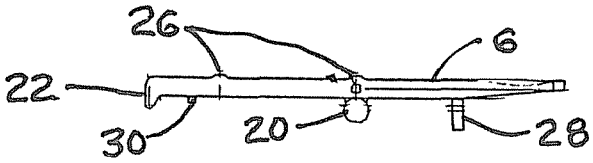
FIG. 8 illustrates a side view of a cantilevered bristle clamping panel.

FIG. 7 illustrates an end view of the cantilevered bristle clamping panel. FIG. 8 illustrates a side view of the cantilevered bristle clamping panel. FIG. 8, in particular, illustrates the downwardly protruding post 26, which prevents the cantilevered panel 6 from being depressed beyond a certain point. The gripping ridge 30 and the bristle clamping ridge 22 cooperate to grip the bristles through the open top edge 31 of the bristle holder 16 (see FIG. 5).

Figure 9:
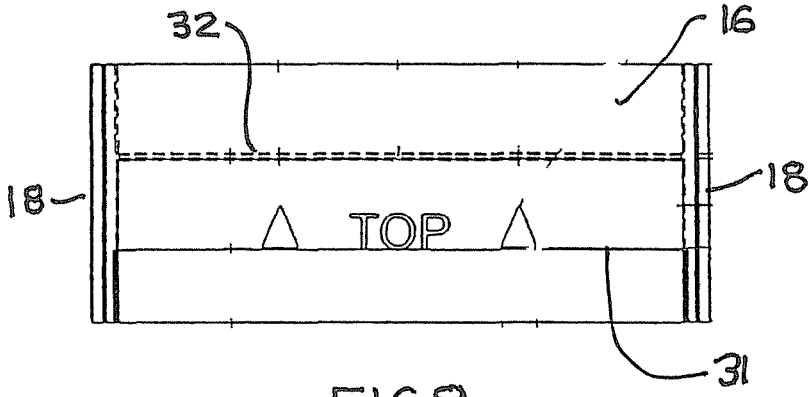
FIG. 9 illustrates a plan view of a bristle holder.

FIG. 9 illustrates a plan view of the bristle holder. As seen in FIG. 9, the bristle holder 16, in a specific embodiment, has a rectangular box-like construction, with opposite guide ridges 18 on each side. The front portion of the top of the bristle holder 16 is cut away to leave an opening which is defined by ridge 31. The opening enables the bristle clamping ridge 22 and the gripping ridge 30 of the panel 6 to drop down onto the bristles held by the bristle holder 16 and thereby grip the bristle holder and bristles firmly in place. As an option, the word "TOP" and a pair of directional triangles can be formed in the top surface of the bristle holder 16 to facilitate the painter inserting the bristle pack 4 properly into the interior cavity of the body of the paint brush (see FIG. 3).

Figure 10:
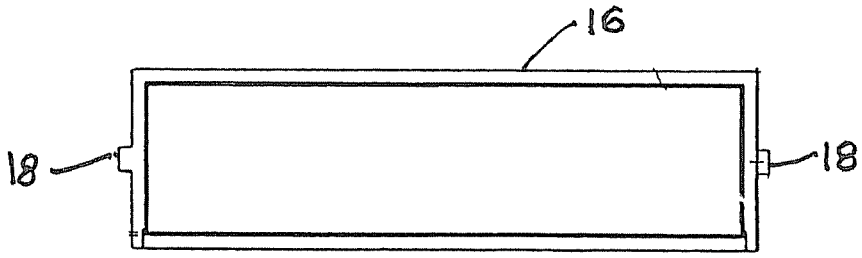
FIG. 10 illustrates a front view of a bristle holder.
Figure 11:
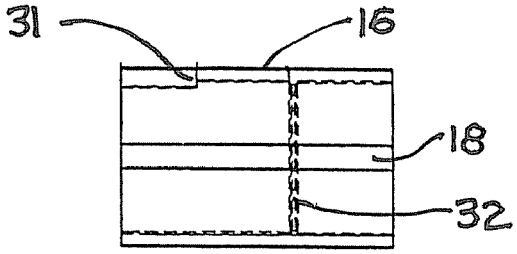
FIG. 11 illustrates a side elevation view of a bristle holder.

FIG. 10 illustrates a front view of the bristle holder. FIG. 11 illustrates a side elevation view of a bristle holder. FIG. 10, in particular, illustrates the pair of side guide ridges 18 formed in the exterior sides of the bristle holder 16. As seen in FIG. 11, a portion of the top surface of the bristle holder 16 is cut away to form an opening with ridge 31 at the interior edge. FIG. 11 also illustrates guide ridge 18 and, in dotted lines, the bristle gripping ridge 32 on the interior of the bristle holder 16.

Figure 12:
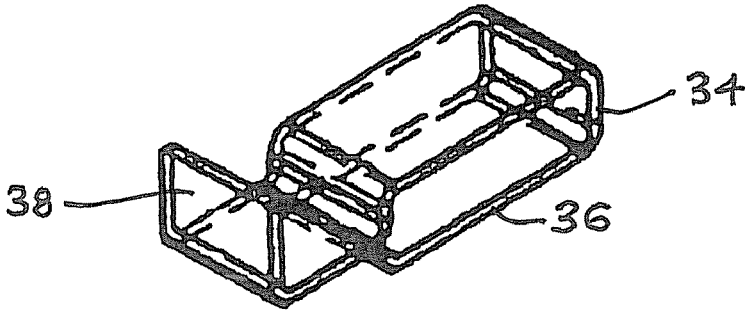
FIG. 12 illustrates an isometric view of a spring clip.
Figure 13:
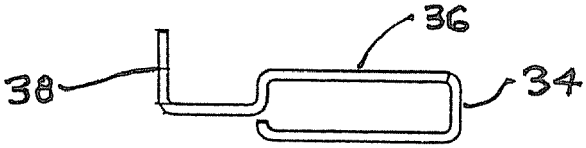
FIG. 13 illustrates a side view of a spring clip.

FIG. 12 illustrates an isometric view of a spring clip. FIG. 13 illustrates a side view of the spring clip. As seen in FIG. 12, the clip spring 34 is formed so that it has an enclosed rectangular shaped body 36 with a protrusion and lip 38 extending from one end thereof. The function of the spring clip 34, as seen in FIG. 3, is to hold the cantilevered panel 6 in an upwardly bristle and bristle holder gripping position, while the bristle pack is in place in the paintbrush and the paintbrush is in use. However, when the painter wishes to remove the bristle pack and bristle holder 16, the painter simply depresses pressure site 24, which in turn depresses the lip 38 of clip spring 34 (see FIG. 3), thereby tilting the panel 6 upwardly at the bristle gripping end 22, thereby releasing the bristle pack 4.

Figure 14:
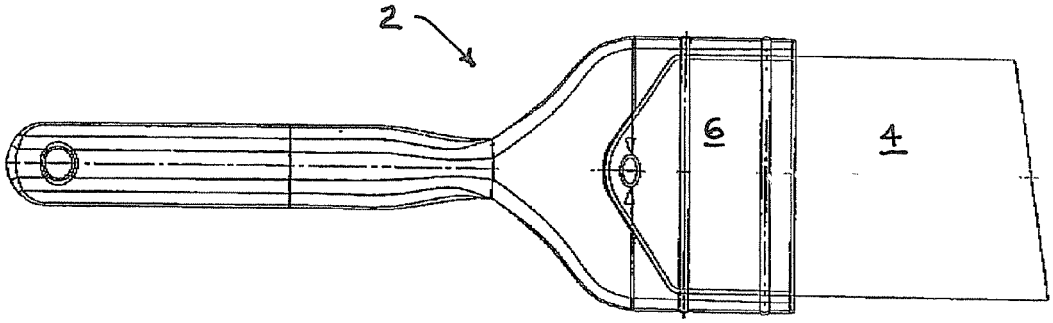
FIG. 14 illustrates a plan view of a paint brush with an alternative design of cantilevered bristle clamping panel.
Figure 15:
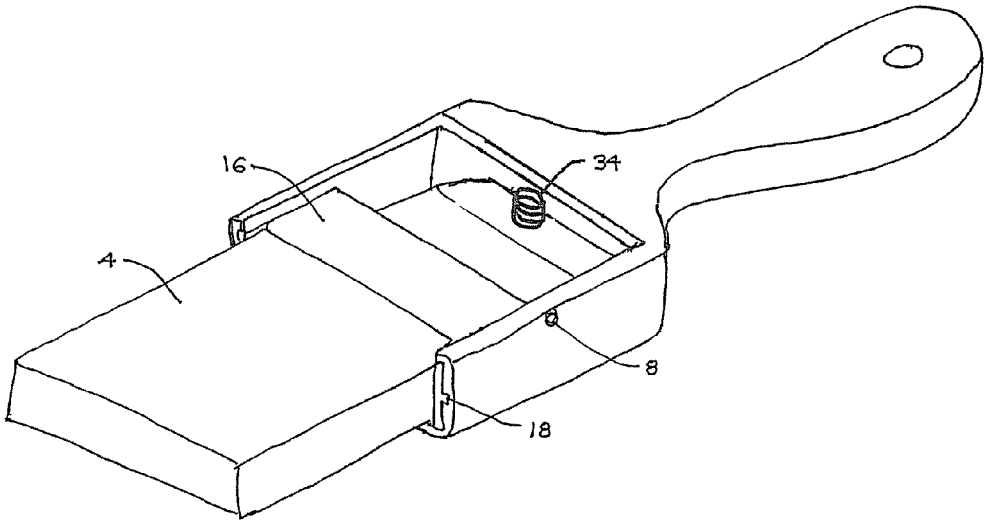
FIG. 15 illustrates an isometric view of a paintbrush with cantilevered panel removed and a coil spring in place of a spring clip.

FIG. 14 illustrates a plan view of a paint brush with an alternative design of cantilevered bristle clamping panel. FIG. 15 illustrates an isometric view of a paintbrush with cantilevered panel removed and a coil spring in place of a spring clip. The pentagonal shaped panel 6 illustrated in FIG. 14 is a second embodiment and is useful if a larger finger pressing area is desired for operating the cantilevered panel. It is understood that other outlines of panels are within the scope of the invention. The coil spring 34 illustrated in FIG. 15 is an alternative design of spring clip. It may be preferred in certain instances. It is understood that other designs of spring clips are feasible within the scope of the invention.

The cantilevered panel paint brush has a number of improvements over conventional paint brushes:

1. The bristle holder box that holds the bristles or filaments. This box has precision measurements and, along with the two side tracks, allows the bristle pack to slide easily into the cavity in the paint brush body. This secure fit prevents movement of the bristles while painting. The box has extended ridges to hold the bristles and prevent seepage. These ridges also deter fanning of bristles when the bristles are squeezed by the flap.
2. The paint brush handle and body. The paint brush handle and body are produced in two steps. The first step is to form the main part which has two inserts in the cavity in the head for the guide ridges of the box to fit into. The handle and body are produced from a tough and durable plastic such as high density polyethylene. The second step is to apply a soft touch coating to give a more comfortable feel for the user. As an option, the handle can be formed in an ergonomic shape, suitable for left or right handed painters.
3. The cantilevered bristle pack gripping panel. The panel has ridges that squeeze the bristles and hold the bristle pack securely. The combination of the ridges and pressure on the bristles prevents paint from seeping onto the bristles.
4. The clip spring. This is flat stainless steel and is used to determine the amount of squeeze of the flap. The engineered spring allows for a professional method of just pressing the flap to release or insert the bristle pack.

Together, these components allow for a precision made high quality paint brush that affords easier cleaning and replacement of bristle at a substantial saving over buying an entire new brush merely because the bristles or filaments have become worn or clogged with paint.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A paintbrush comprising:

(a) a paintbrush body and handle, the body having formed therein at an end opposite the handle, a cavity, said cavity having a first side opening opposite the handle for releasably receiving a bristle holder and a bundle of parallel bristles, said cavity having a second side opening which is adjacent the first side opening and the bristle holder and bristles when in place in the cavity in the body;

(b) a bristle holder holding a bundle of parallel bristles, the holder and bristles removably fitting into the cavity through the first side opening; and (c) a bristle holder panel pivotally secured to the body in the second side opening by a pair of mid-point pivots, one located on each lateral side of the second side opening, the mid-point pivots enabling the panel to move in a cantilever manner in the second opening along an axis which is aligned with the body and handle, the panel at a first region opposite the handle gripping the bristle holder and bristles when in a first position and releasing the bristle holder and bristles when tipped about the mid-point pivots to a second position.

2. A paintbrush as claimed in claim 1 wherein the bristle holder has on at least one side thereof a ridge which fits in a guide groove formed in one interior side of the cavity.

3. A paintbrush as claimed in claim 2 wherein the bristle holder has a pair of ridges, located on opposite sides of the bristle holder, which fit in respective guide grooves formed in each interior side of the cavity.

4. A paintbrush as claimed in claim 1 wherein the pair of mid-point pivots are protrusions located at mid-points on each lateral side of the panel, the protrusions fitting in corresponding holes formed at the mid-points in the lateral sides of the second opening of the paintbrush body.

5. A paintbrush as claimed in claim 1 wherein the panel has formed thereon a bristle holder gripping ridge on the side of the panel facing the interior of the cavity.

6. A paintbrush as claimed in claim 5 wherein the panel has formed thereon a second bristle holder gripping ridge adjacent the first ridge.

7. A paintbrush as claimed in claim 1 wherein the cavity includes in the interior thereof a spring which when in a first uncompressed position holds the panel in a position which grips the bristle holder and bristles and when in a second compressed position, enables the panel to release the bristle holder and bristles.

8. A paintbrush as claimed in claim 7 wherein the spring is a resilient clip.

9. A paintbrush as claimed in claim 7 wherein the spring is a coil spring.

10. A paintbrush as claimed in claim 1 wherein the bristle holder has formed in the interior of the cavity a bristle gripping ridge.

11. A paintbrush as claimed in claim 1 wherein the panel includes thereon opposite the bristle clamping end of the panel a location for depressing the panel.

12. A paintbrush as claimed in claim 1 wherein the panel has formed on the underside thereof facing the cavity a device which prevents the panel from being depressed beyond a certain point.

13. A paintbrush as claimed in claim 12 wherein the device is a post.

14. A paintbrush as claimed in claim 1 wherein the panel has a rectangular configuration.

15. A paintbrush as claimed in claim 1 wherein the panel has a pentagonal configuration.

* * * * *